United States Patent [19]

Gueret

[11] Patent Number: 4,463,485

[45] Date of Patent: Aug. 7, 1984

[54] DEVICE FOR DEEP MASSAGE OF THE SKIN

[75] Inventor: Jean-Louis H. Gueret, Paris, France

[73] Assignee: L'Oreal, Paris, France

[21] Appl. No.: 349,403

[22] Filed: Feb. 16, 1982

Related U.S. Application Data

[63] Continuation of Ser. No. 139,814, Apr. 14, 1980, abandoned.

[30] Foreign Application Priority Data

Apr. 19, 1979 [FR] France ..... 79 09897

[51] Int. Cl.[3] ..... A61H 7/00

[52] U.S. Cl. ..... 128/62 R; 128/67

[58] Field of Search ..... 128/24 R, 25, 25 B, 128/44, 51–57, 60, 62 R, 62 A, 64, 65, 67, 80 D, 581, 582, 38, 39, 63; 15/110, 188, 215; 4/581, 583; D4/31, 32, 35; D28/63; D24/36, 41

[56] References Cited

U.S. PATENT DOCUMENTS

D 99,532 4/1936 Grapp ..... 15/110

1,819,628 8/1931 Van Sant ..... 128/65

2,206,726 7/1940 Lasater ..... 15/110

2,290,378 7/1942 Motto ..... 128/57

FOREIGN PATENT DOCUMENTS 683595 9/1939 Fed. Rep. of Germany ..... 128/54

388246 2/1933 United Kingdom ..... 15/110

399596 10/1933 United Kingdom ..... 128/67

*Primary Examiner*—Richard J. Apley

*Assistant Examiner*—David J. Brown

*Attorney, Agent, or Firm*—N. Jerome Rudy

[57] ABSTRACT

A massaging applicator includes a plurality of stumps *5a, 5b* of smaller and large cross-section, respectively. The thinner stumps *5a* which bend more easily alternate regularly with the thicker stumps so that two of the thicker stumps are followed by two of the thinner stumps when considered along the obvious direction of massaging, in this case perpendicular to the axis of a handle 3. The stumps may be cylindrical or conical and may be arranged in straight rows or in concentric circles.

11 Claims, 2 Drawing Figures

DEVICE FOR DEEP MASSAGE OF THE SKIN

This Application is a Continuation of the currently-pending but herewith abandoned Application for U.S. Letters Patent of the present Applicant (all assigned to the Sociét/é L'OREAL of PARIS, France) having Ser. No.: 06/139,814, now abandoned which was filed Apr. 14, 1980 and was entitled "DEEP MASSAGE DEVICE FOR THE SKIN".

There are already known various massage instruments for manual use to create a localised hyperaemia in the skin zones subjected to massage. This localised hyperaemia is formed by a congestion due to an activation of the underlying blood circulation and it may favor the penetration of appropriate substances. Thus this effect may be used to good advantage, especially in the cosmetic field to cause various treatment creams or lotions to penetrate into the zone of the hyperaemiated skn obtained by massage.

Amongst the current massaging instruments, there may be cited the horsehair glove and the massage brush. The latter generally presents, on one active side, a multiplicity of tips or stumps which, in passing over the skin, produce a slight depression of the latter and, by way of reaction, a localised hyperaemia.

Particularly representative of the state of the art pertaining to appliances and devices for physical treatment of skin and other superficial human tissue and anatomy are, brought forth by way of illustrative mention: U.S. Pat. No. Design: 99,532 to G. L. Grapp (which concerns a "tongue brush"); U.S. Pat. No.: 2,290,378 to M. Motto (which relates to a scrub-roller device); U.S. Pat. No.: 1,819,628 to R. H. Van Sant (disclosing an "ointment-feeding" massage applicator having uniformly large nipples or prongs for skin contact); U.S. Pat. No.: 2,206,726 to R. L. Lasater (involving a mechanically-vibrated tooth brush); British Pat. No.: 388,246 to Deglesne (concerning a shaving brush device with finger constructions set within the bristle placements); German Pat. No.: 683,595 to Geisbert (involving a paddle to "pat" or "slap" skin for the possible stimulation thereof); and the chain-like skin-treating structure of French Patent Of Addition No.: 77 21579 to J. Stellini as well as the comb-like brush affair disclosed in German Pat. No.: 150,638. The same, however, are not of especial relevance to the present contribution to the art and do not appear to be realistically pertinent to or anticipatory of what is here disclosed and involved as hereinafter more fully delineated.

In U.S. patent application Ser. No. 32,685, filed on Apr. 23, 1979, now U.S. Pat. No. 4,249,521 there are disclosed various forms of a massage brush whose active side has been provided with massaging projections.

In one embodiment, the projections are stumps each having a concave part and an opposite convex part. Thus, the stumps had the characteristic of presenting a resistance to bending which was higher if one pressed against their convex parts and a lower resistance when one pressed against their concave parts. Moreover, the stumps were arranged alternately head to tail. In other words, one stump whose concavity pointed in one direction was adjacent a stump whose concavity was turned in the opposite direction.

The advantage of the above applicator was twofold. Firstly, the effectiveness of the cutaneous massage was improved to a notable extent in comparison with that which could be obtained by the previously known massaging instruments such as a horsehair glove for instance. In fact, rubbing against the skin with stumps having alternate zones whose resistance to bending in the direction of displacement of the applicator is high and zones whose resistance to bending in the same direction is lower produces on the skin wavy or sinuous depressions which are displaced on the skin as the applicator advances. Moreover, since the stumps were made of a flexible elastically deformable material, such an applicator promoted an energetic massage of the cutaneous covering without the risk of lesions or abrasion of the epidermal layers. At the same time, it was capable of perfect adaptation to the various morphological features of the users.

In a second embodiment of massaging brush disclosed in the said U.S. patent application Ser. No. 32,685 the asymmetrical stumps are replaced by continuous projections extending along a wave-shaped center line; these projections having, like the stumps, a higher bending resistance when their convex part is acted on and a lower resistance when their concave part is acted on.

The object of the present invention is to provide a different arrangement in which the difference in flexibility of the stumps derives, not from the presence of concave or convex parts but from other characteristics of the stumps, including: the difference in cross-section between the stumps so that the stumps of a small cross-section are, with an equal height, more flexible than the stumps with a greater cross-section.

Accordingly the present invention provides an applicator which may be used for massaging the cutaneous covering having, on at least one active side, projecting stumps made of a flexible, elastically deformable material, there being at least two kinds of said stumps having substantially the same configuration but different dimensions, namely and on the one hand stumps of a smaller cross-section and on the other hand stumps of a larger cross-section regularly alternating with the stumps having the smaller cross-section.

Thus, in the present invention, provision is made for at least two kinds of stumps with an identical configuration but with a different cross-section. These stumps are disposed on the active side of the applicator so as to procure substantially the same massaging effect as that obtained by the applicator of the above-mentioned U.S. patent application Ser. No. 32,685. It may be noted that the stumps of smaller cross-section, which bend to a greater extent than the stumps of a greater cross-section, having a bending capability remaining the same, irrespective of the zone of the stump which is pressed, in contrast to the asymmetric stumps of the said U.S. patent application Ser. No. 32,685 which have little flexibility in one direction and great flexibility in the opposite direction.

In a preferred embodiment: the set of stumps has substantially the same height; each stump is substantially derived by revolution around an axis; the stumps are substantially cylindrical or conical and have a rounded free tip; and the stumps are made integrally with a support base in a flexible rubbery material.

In the present invention, the stumps may be disposed: either along substantially parallel rows; or in opposite waves; or along concentric circles in which case the massage remains the same irrespective of the direction of displacement of the applicator over the cutaneous covering. In each case, the different strengths of stumps may be varied in the rows or circles to obtain the desired massaging effect.

The applicator of the present invention may consist of a massage brush whose flexible base for the stumps is inserted within a rigid head which may or may not be connected to a handle. It may instead consist of a massage glove; that is to say a flexible pocket having the stumps projecting from at least one of its sides. The applicator of the present invention may instead be used not only for massaging but also for simultaneous washing of the cutaneous covering. In this case, as in a third embodiment disclosed in the said U.S. patent application Ser. No. 32,685, the flexible base on which the stumps are supported is provided with perforations and is connected to a receptacle capable of containing a soap tablet.

In order that the present invention may more readily be understood one embodiment, represented on the attached Drawing, will be described below by way of a purely illustrative and non-restrictive example. In the respective portrayals of this Drawing.

Figure 1:
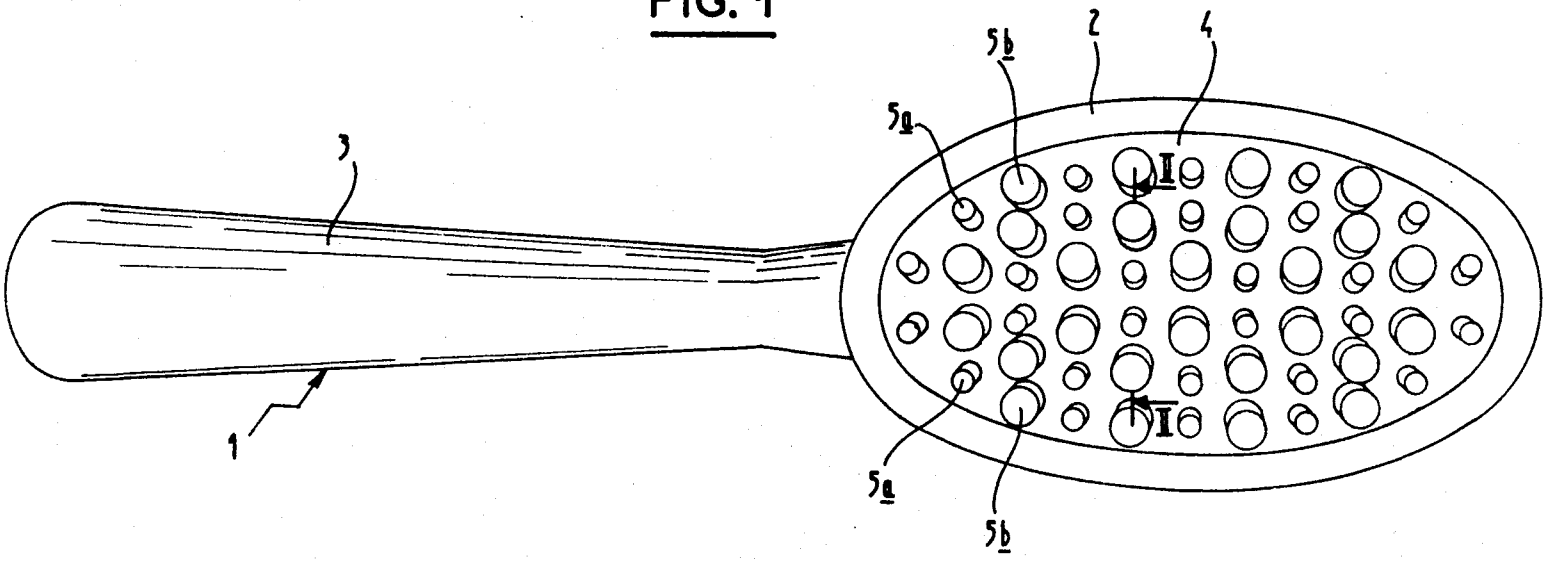
FIG. 1 represents a plan view of a brush according to the invention.
Figure 2:
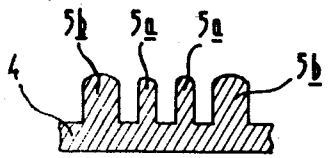
FIG. 2 represents a partial cross-sectional view of the stumps of the brush taken along the line II—II of FIG. 1.

Referring to the Drawing, there will be seen a brush 1 intended for massaging the cutaneous covering. The head 2 of brush 1 is made integrally with handle 3. However, the head 2 and handle 3 may be made of any appropriate material, for instance of wood or by molding of a plastics material. On one of the sides of head 2 is a cavity of elongate shape having a substantially elliptical longitudinal cross-section. Within this cavity, there is mounted a flexible base 4 on which there are provided in relief thinner and thicker stumps 5*a*, 5*b*, respectively. These serve to massage the cutaneous covering.

In this example, the flexible base 4 and stumps 5*a*, 5*b* are made of a single piece by molding of a flexible rubbery material. The flexible base 4 consists of a plate of an elliptical periphery whose surface area is slightly greater than that of the substantially elliptical cavity in the head 2. It follows that, when positioned on the head 2, the flexible base 4 has a curved configuration whose convexity is directed away from the head of the brush.

Stumps 5*a*, 5*b* are disposed along parallel rows, interspaced from each other at substantially the same distance. The rows of stumps 5*a*, 5*b* extend perpendicularly to the major axis of the flexible base 4 which is identical with the axis of handle 3. Two of the thinner stumps 5*a* regularly alternate with two of the thicker stumps 5*b*. The stumps 5*a*, 5*b* situated on the periphery of the flexible base 4 are arranged along an ellipse which is substantially homothetic with that formed by the cut out of flexible base 4.

The configuration of the thinner stumps 5*a* is strictly identical with that of the thicker stumps 5*b*. Each stump 5*a*, 5*b* has the shape of a cylinder of revolution on a circular base, and the free tip of all the stumps 5*a* and 5*b* is slightly rounded. Stumps 5*a*, 5*b* have the same height and the only difference between them derives from the fact that stumps 5*a* have a cross-section of a smaller diameter than stumps 5*b*. As a result of this difference in cross-section, the thinner stumps 5*a* are more flexible than the thicker stumps 5*b*. Of course, the bending capability of the various stumps 5*a*, 5*b* depends not only on their diameter but also on other parameters, particularly on their height and the material of which they are made. Depending on the desired difference in flexibility and according to the massage effect looked for, the expert will therefore be able to determine easily by means of purely routine experiments the ratio of the cross-sections which must be adopted between the thinner and thicker stumps 5*a* and 5*b* in accordance with the nature of the material used and a given height of the stumps.

In this example the height of the stumps 5*a*, 5*b* is approximately 10 mm. The diameter of the thinner stumps 5*a* is approximately 3.5 mm; that of the thicker stumps 5*b* is approximately 5.5 mm. The stumps are made of an elastomer whose "Shore" hardness is approximately 35°.

As has been seen, by reason of their smaller diameter the stumps 5*a* are more flexible than stumps 5*b*. On contact with the skin, stumps 5*a* therefore appear "softer" and stumps 5*b* "harder". Because of this, when a rectilinear massage is effected by displacing the brush 1 parallel to its axis, the skin zone over which the brush is displaced is subjected to the action of a multiplicity of alignments of low flexibility stumps and alternately, high flexibility stumps. Thus, the alignments of the stumps passing over the skin therefore creates a slight depression on the surface of the latter with this depression having the shape of an undulation or wave which, on the passing of the following alignment of stumps, is reversed. This is because two stumps 5*a* of one alignment follow two stumps 5*b* of the following alignment, and vice versa. The result is a very effective massage which produces, in the treated skin zone, a suitable hyperaemia promoting the penetration of various treatment creams or lotions.

It may be noted that, by reason of the flexible material of which the stumps 5*a*, 5*b* are made, and also because of the configuration which has been given to them, even with an energetic massage the brush 1 cannot cause either abrasion nor a destruction by friction of the epidermal layers.

I claim:

1. An applicator for massaging the cutaneous covering or skin of a living body, said applicator being adapted when pressed against and moved laterally and rectilinearly over said cutaneous cover-skin to be capable of effecting and producing a wave-like, undulating and rippling motion in the skin undergoing massage under the influence of the applicator which is favorable to the inducement of beneficial hyperaemia in said skin, said applicator comprising:

an applicator body having at least one active side;

said active side having an at least substantially, relatively plate-like configuration;

said applicator body being provided on each active side thereof with diverse protudent sets of digitate stumps thereon arranged in respective and relative interdispersed disposition in and as first and second sets thereof in such arrangement;

the said first and second sets of stumps being made of a flexible, elastically-deformable material and projecting from said at least one active side of said applicator body; with the stumps of said first and second sets all having:

substantially the same configuration with, in said configuration;

convexly-terminating free tip ends; with the said tip ends being so formed and shaped as to be free from and conspicuous in their absence of having any cup-like, suction-producing termination constructions thereof and thereon; and as a further distinguishing construction (thereabout) of said tip ends, being also so formed as to have at least substantially the same heigt of each above the said active side on which they are provided;

but with different width dimensions such that the stumps of said first set have a smaller cross-section than the stumps of said second set so that the thinner-width first-set stumps have relatively-higher flexibility and bendability thereabout as compared to the relatively-lower flexibility and bendability of the thicker-width stumps of said second set;

with the sets of stumps also being so arranged that the stumps of said first and second sets are in a regularly-alternating configuration across said at least one active face on which they are provided; such that said protrudent first and second stump sets are set in a pattern as shown in FIG. 1; and the said stumps arrangement and alignments thereof on each active face of said applicator on which they are provided is adapted upon contacting-passage of the applicator over skin in any given direction of such movement to create a slight depression on the surface of the latter due to the diverse flexibility characteristics of said respective first and second set stumps which depression assumes the shape of said wave-like, undulating and rippling motion in the skin undergoing massage by means of said applicator.

2. An applicator device for deep massage of the skin that is in accordance with that of claim 1 and which is yet further characterized in being:

devoid of any means for mechanical and activated by passing of same over skin surface(s) for rotation about any axis of said body of said activator during usage thereof.

3. An applicator according to claim 1, wherein each of said stumps of said first and second sets is substantially derived by revolution around an axis.

4. An applicator according to claim 3, wherein all of said stumps are substantially cylindrical and have a rounded free tip.

5. An applicator according to claim 3, wherein all of said stumps are substantially conical with a rounded apex.

6. An applicator according to any one of claims 1 or 3–5, inclusive and including a base member defining said active side of the applicator body, said stumps of said first and second sets being made integrally with said base member by molding of a flexible rubbery material.

7. An applicator according to any one of claims 1 or 3–5, inclusive, wherein the stumps of said first and second sets are raised in substantially parallel rows on the said at least one active side of the applicator body.

8. An applicator according to any one of claims 1 or 3–5, inclusive, wherein the stumps of said first and second sets are arranged in an array of concentric circles.

9. An applicator according to any one of claims 1 or 3–5, inclusive, wherein said applicator body is in the form of a massage brush having a rigid head, and a base member which is disposed in said head and has the various stumps thereon.

10. An applicator according to claim 9, and including a handle connected to said head.

11. An applicator according to any one of claims 1 or 3–5, inclusive, wherein said applicator body constitutes a soap carrier comprising a base, a receptacle capable of containing a tablet of soap, and means defining perforations of said base, the stumps being mounted on said base.

* * * * *